US010541091B2

(12) United States Patent
Miyakawa et al.

(10) Patent No.: US 10,541,091 B2
(45) Date of Patent: Jan. 21, 2020

(54) CONTACT STRUCTURE FOR SWITCH AND PRESSURE SWITCH USING THE SAME

(71) Applicant: Saginomiya Seisakusho, Inc., Tokyo (JP)

(72) Inventors: Satoshi Miyakawa, Tokorozawa (JP); Tomohiro Sakakibara, Tokorozawa (JP)

(73) Assignee: Saginomiya Seisakusho, Inc., Tokyo (JP)

( * ) Notice: Subject to any disclaimer, the term of this patent is extended or adjusted under 35 U.S.C. 154(b) by 0 days.

(21) Appl. No.: 14/439,078

(22) PCT Filed: Oct. 16, 2013

(86) PCT No.: PCT/JP2013/078093
§ 371 (c)(1),
(2) Date: Apr. 28, 2015

(87) PCT Pub. No.: WO2014/069238
PCT Pub. Date: May 8, 2014

(65) Prior Publication Data

US 2015/0287550 A1 Oct. 8, 2015

(30) Foreign Application Priority Data

Oct. 29, 2012 (JP) ..... 2012-238068

(51) Int. Cl.
*H01H 1/06* (2006.01)
*H01H 1/32* (2006.01)

(52) U.S. Cl.
CPC ..... *H01H 1/06* (2013.01); *H01H 1/32* (2013.01); *H01H 2203/002* (2013.01); *H01H 2203/024* (2013.01)

(58) Field of Classification Search
CPC ..... H01H 1/06; H01H 1/32; H01H 2203/002; H01H 2203/024
(Continued)

(56) References Cited

U.S. PATENT DOCUMENTS 2,490,020 A * 12/1949 Enzler ..... H01H 1/06 200/242
4,278,855 A * 7/1981 Rossi ..... H01H 5/18 200/275
(Continued)

FOREIGN PATENT DOCUMENTS

GB 2102705 A 2/1983
JP 60-121227 U 8/1985
(Continued)

*Primary Examiner* — Edwin A. Leon
*Assistant Examiner* — Lheiren Mae A Caroc
(74) *Attorney, Agent, or Firm* — The Webb Law Firm

(57) ABSTRACT

Provided is a contact structure for a switch, in which a contact region is increased, a conduction failure can be more precluded, and the operational reliability of the switch can be improved by allowing contact points between contacts to be line contacts. The contact structure for a switch includes a pair of contacts that are opposed to each other to open or close the switch by allowing the contacts to come into contact with or to separate from each other, wherein a contact surface of a first contact is formed into a concave shape provided with a projection and a recess; a contact surface of a second contact is formed into a rounded surface; and the projection of the first contact and the rounded surface of the second contact are configured to come into contact with each other.

14 Claims, 12 Drawing Sheets

(58) Field of Classification Search
USPC ..... 200/248
See application file for complete search history.

(56) References Cited

U.S. PATENT DOCUMENTS

| | | | | | |
|---|---|---|---|---|---|
| 4,639,566 | A * | 1/1987 | DeHaitre | H01R 9/2433 | 200/16 R |
| 5,416,969 | A * | 5/1995 | Miura | H01H 11/041 | 200/257 |
| 5,424,700 | A | 6/1995 | Santarelli | | |
| 5,459,295 | A * | 10/1995 | Ohta | H01H 1/58 | 200/244 |
| 6,191,375 | B1 * | 2/2001 | Cardona | H01H 1/06 | 200/246 |
| 6,686,547 | B2 * | 2/2004 | Kern | H02J 9/06 | 200/240 |
| 8,907,236 | B2 * | 12/2014 | Mittelstadt | H01H 73/04 | 200/239 |
| 2006/0084292 | A1 * | 4/2006 | Nishikawa | B60Q 1/441 | 439/74 |

FOREIGN PATENT DOCUMENTS

| | | |
|---|---|---|
| JP | 02-072519 | 3/1990 |
| JP | 02-260331 | 10/1990 |
| JP | 02-260336 | 10/1990 |
| JP | 6-200856 A | 7/1994 |
| JP | 2000188028 A | 7/2000 |
| JP | 2000-322963 | 11/2000 |
| JP | 2001-023488 | 1/2001 |
| JP | 2002-260504 | 9/2002 |
| JP | 2002-343207 | 11/2002 |
| JP | 2005-116452 | 4/2005 |

* cited by examiner

[Fig. 1]
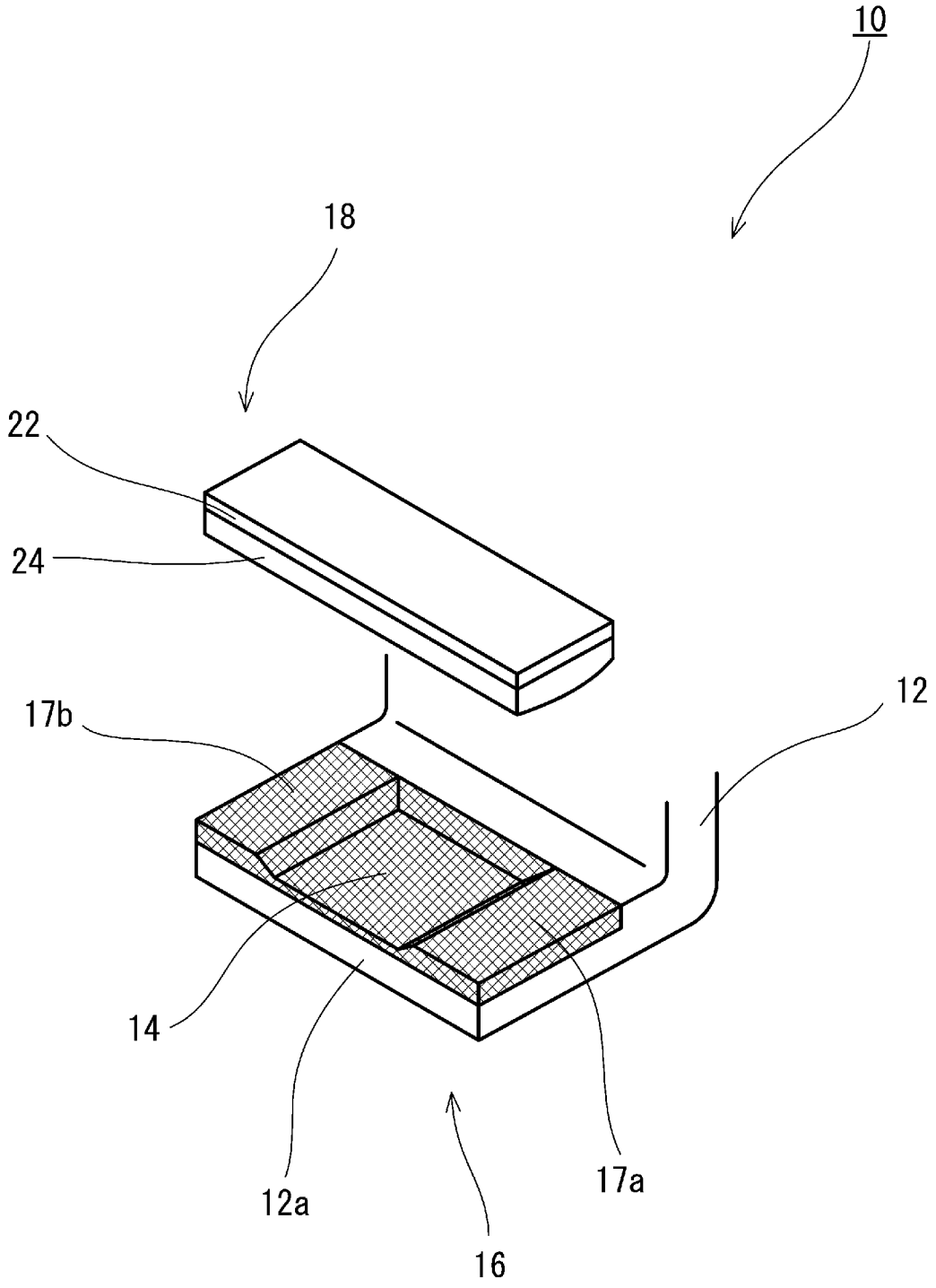

[Fig. 2]
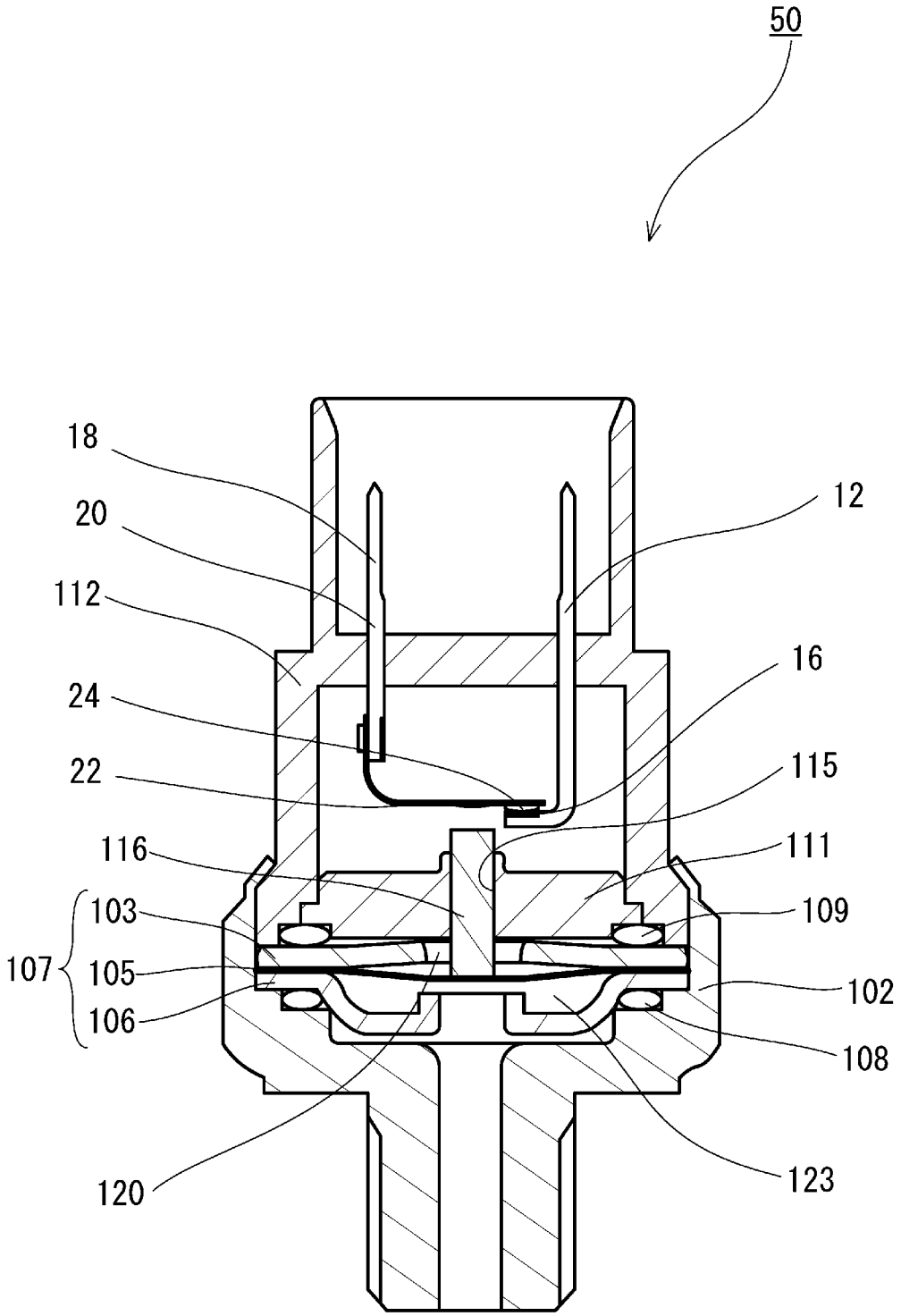

[Fig. 3]
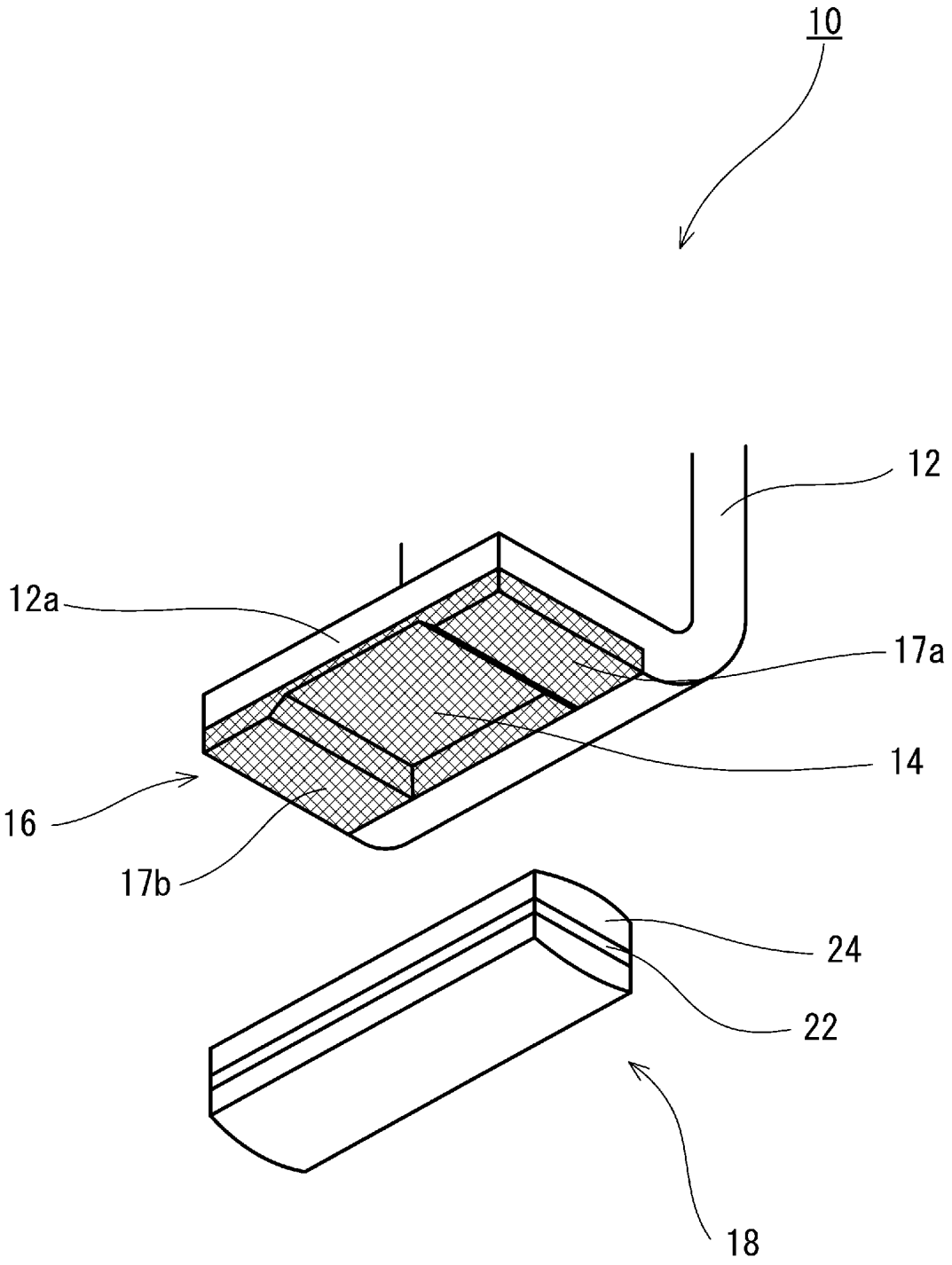

[Fig. 4]
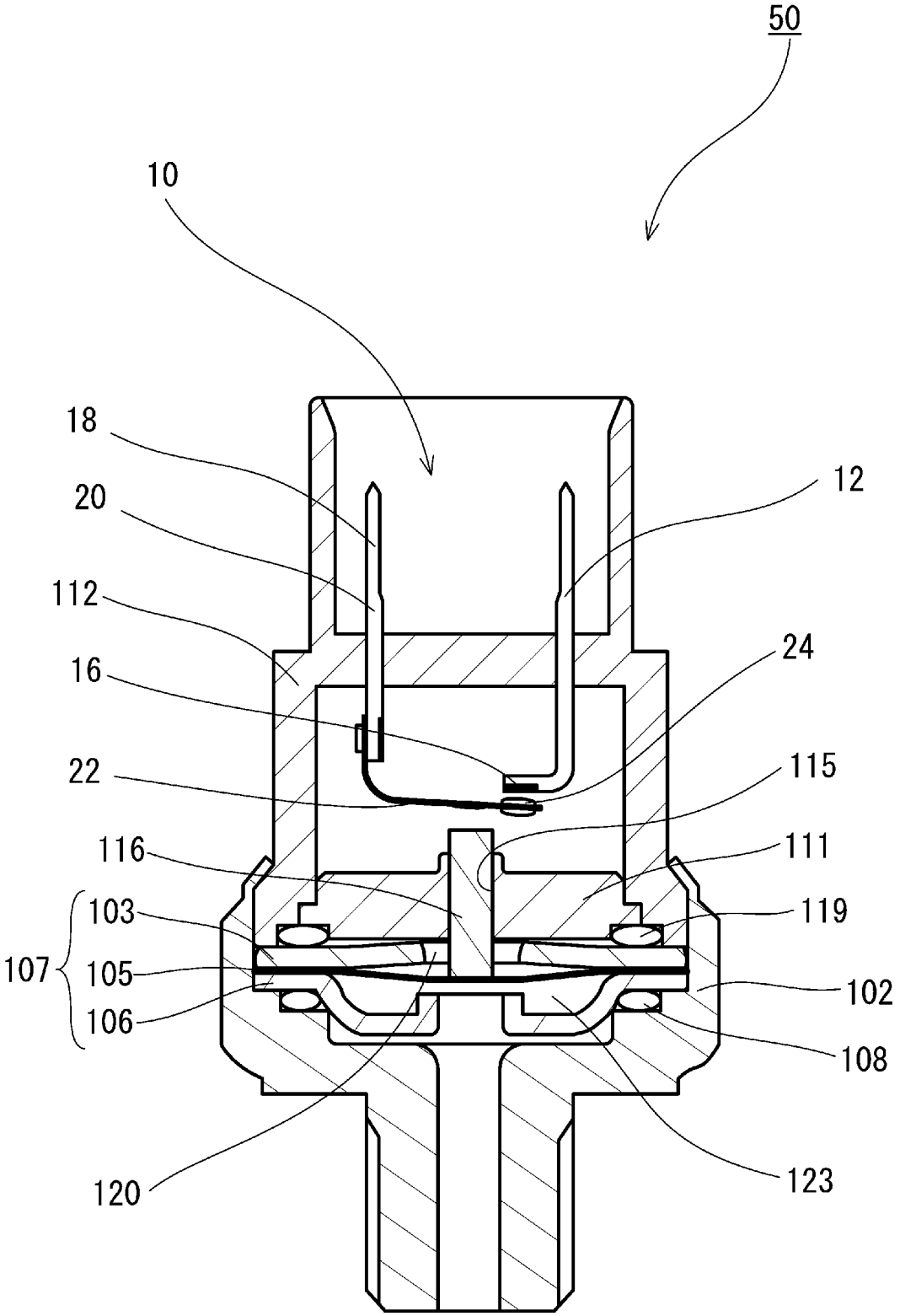

[Fig. 5]
(a)
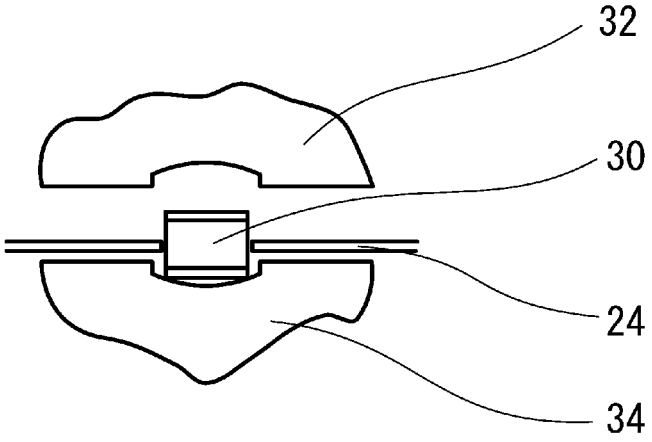
(b)
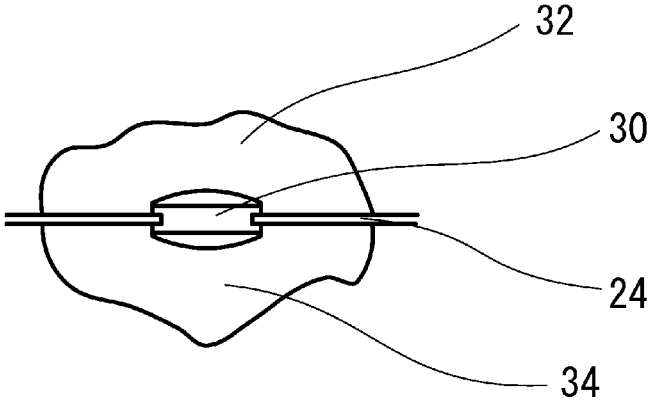
(c)
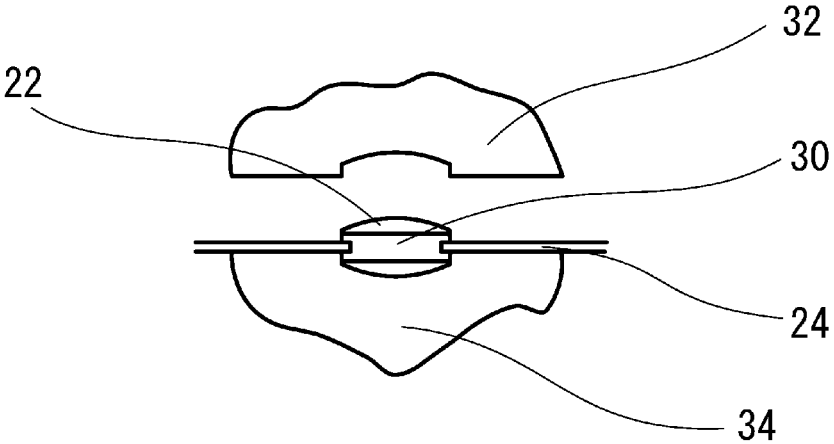

[Fig. 6]
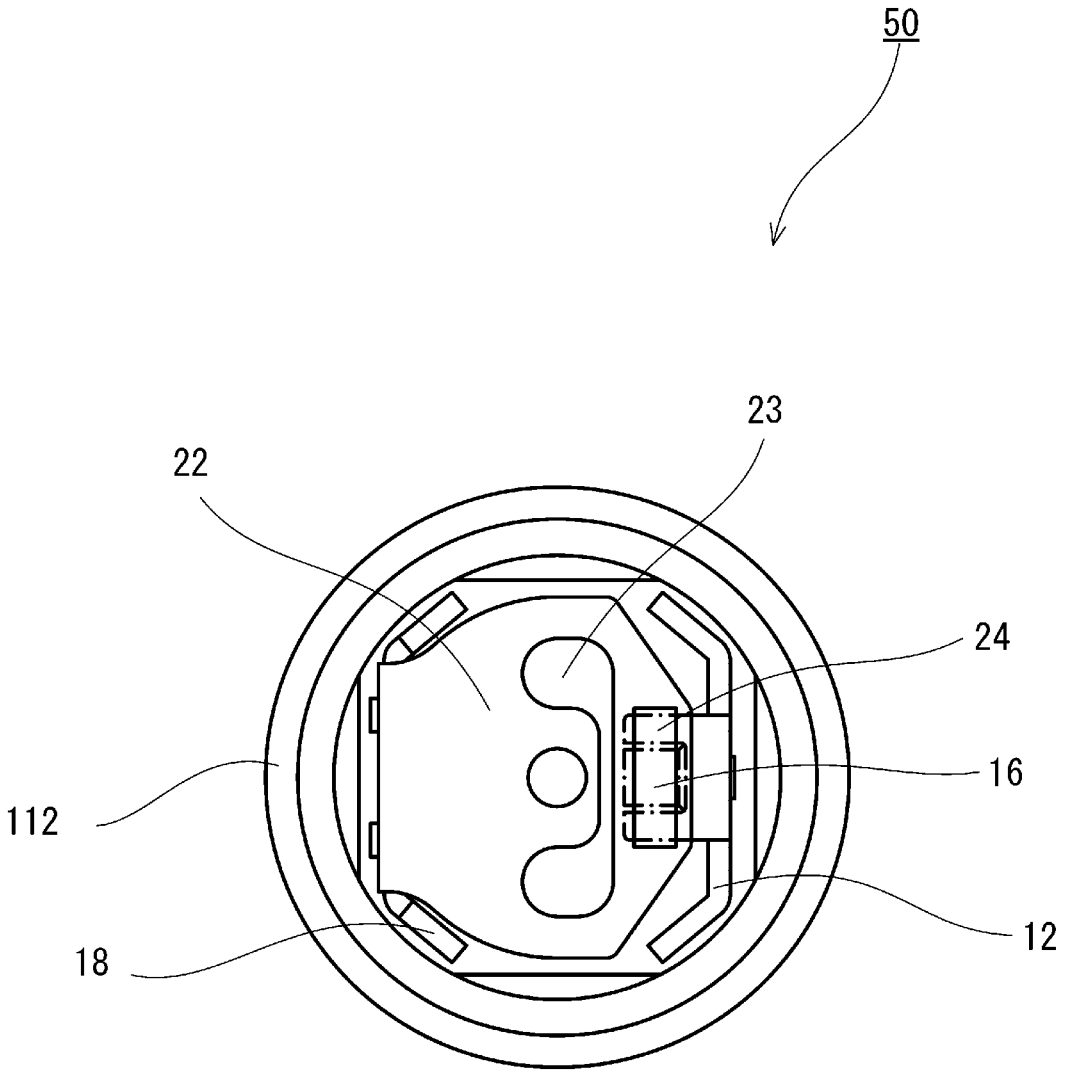

[Fig. 7]
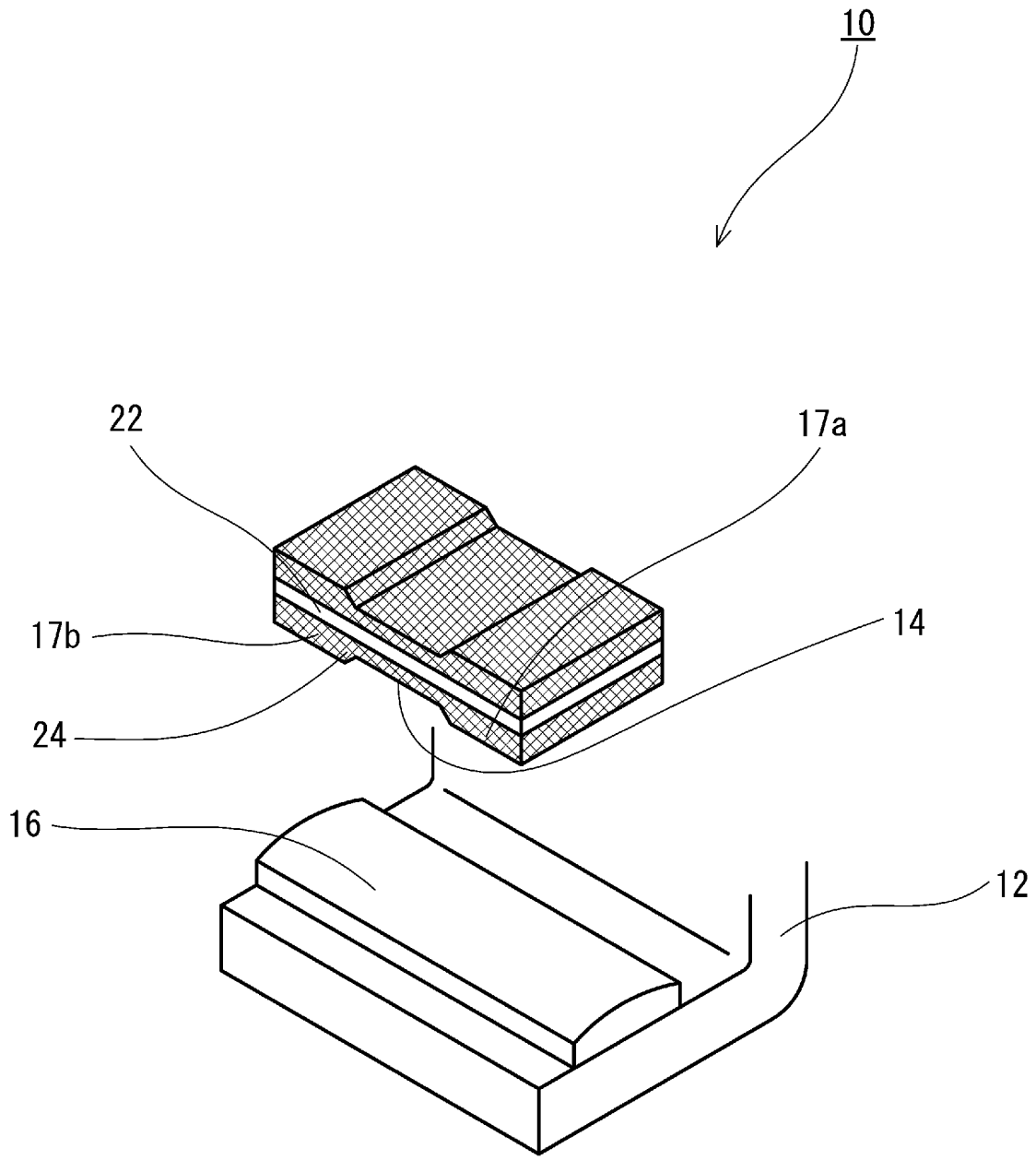

[Fig. 8]
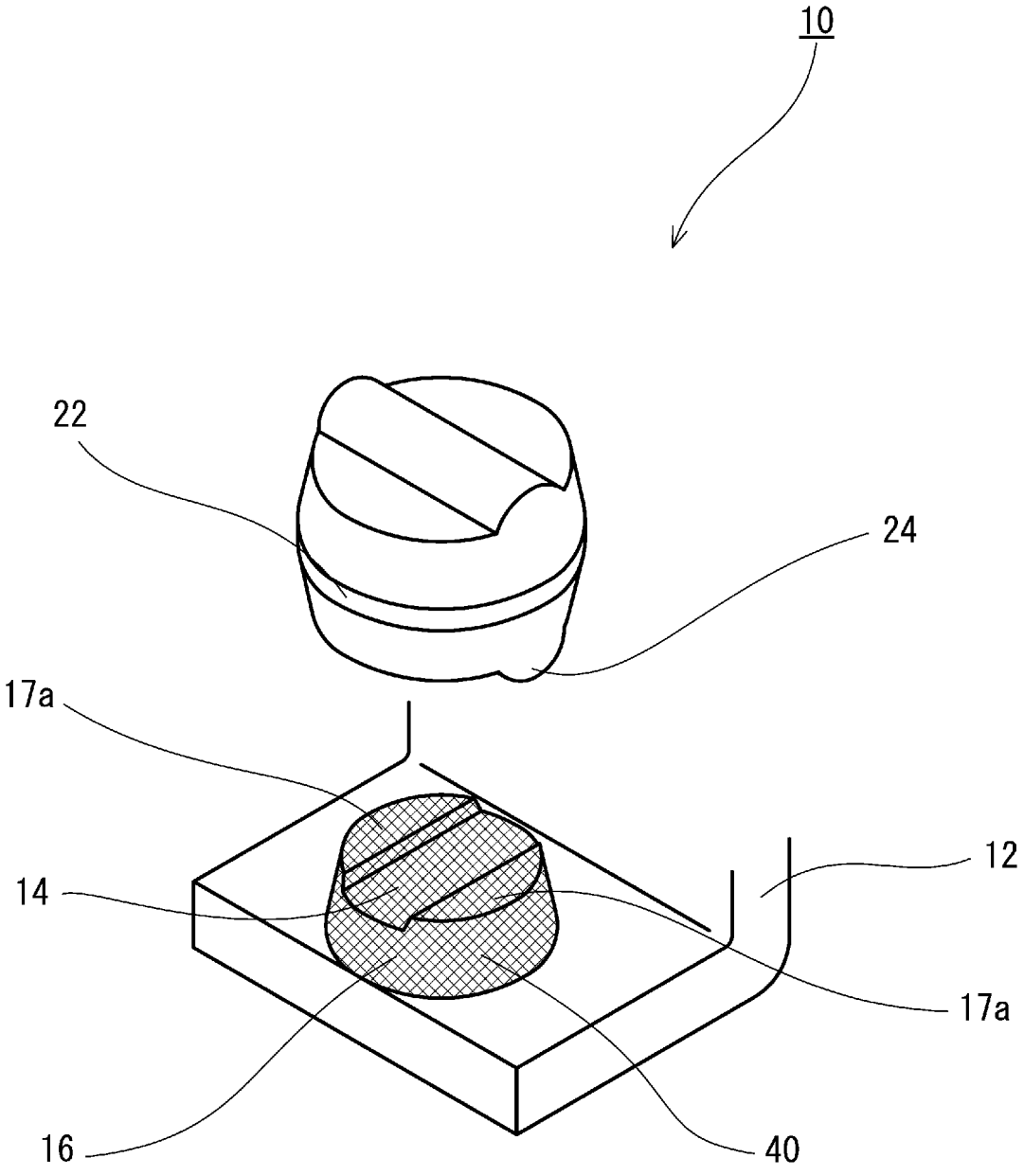

[Fig 9]
Prior Art
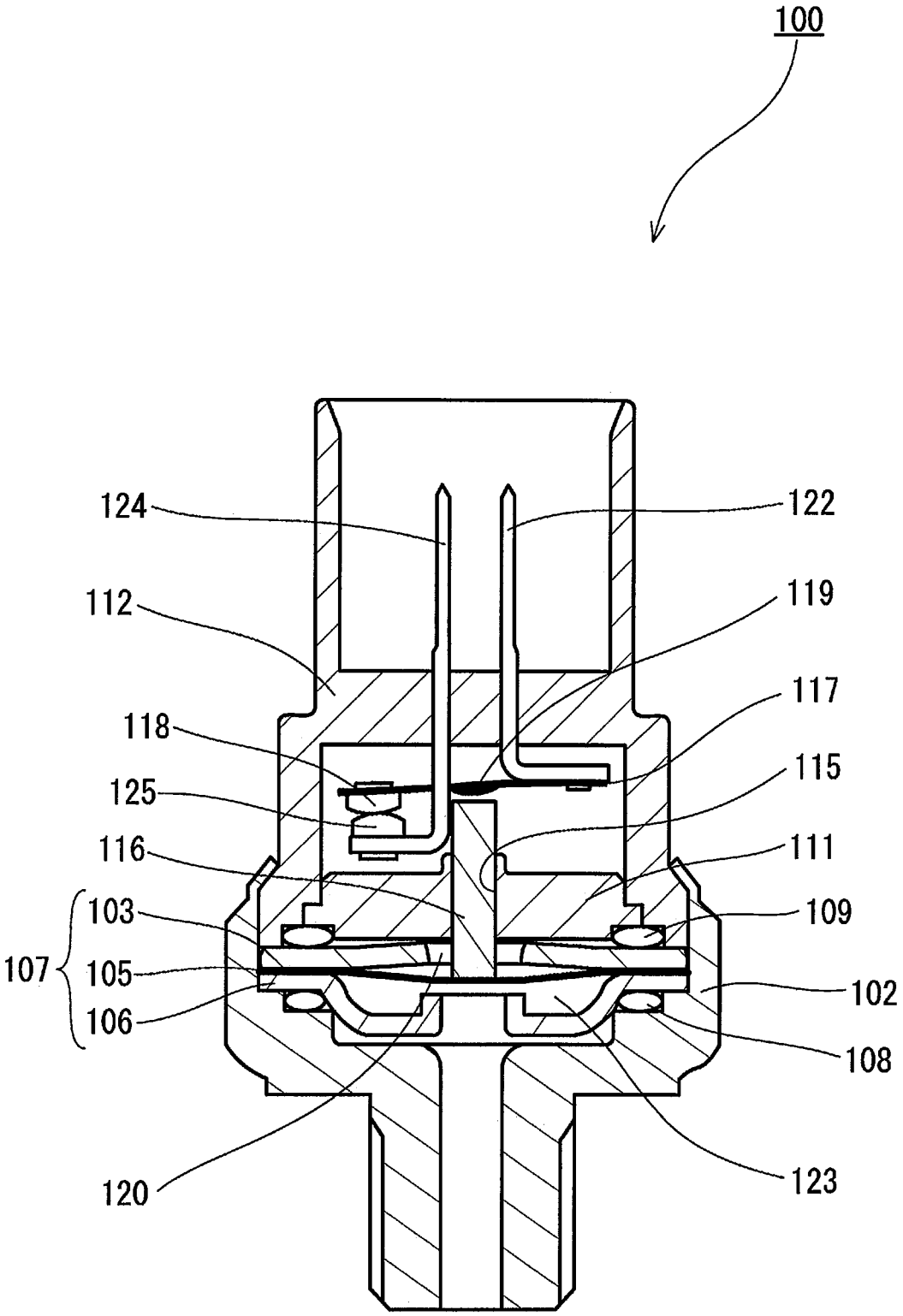

[Fig. 10]
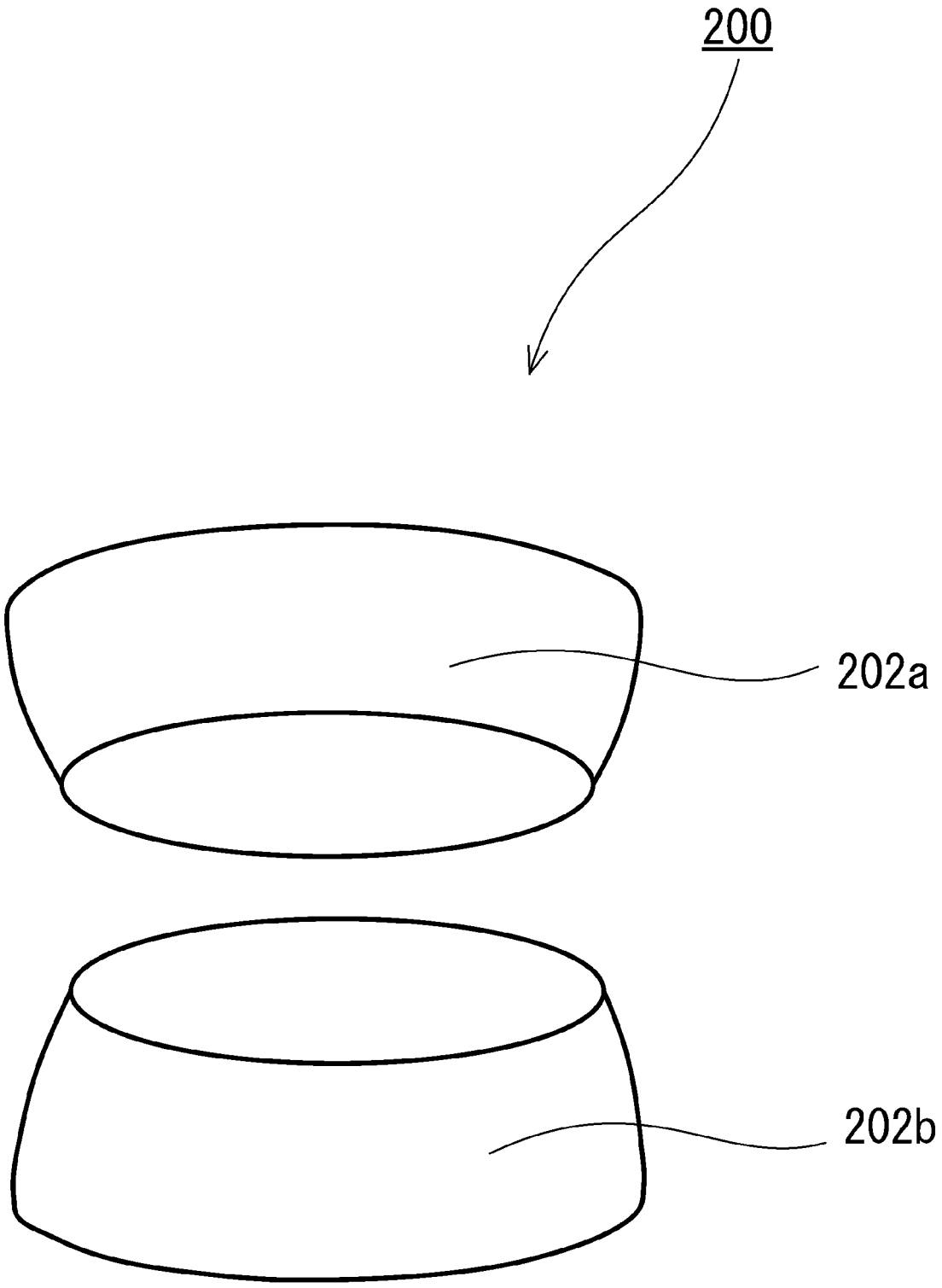

[Fig. 11]
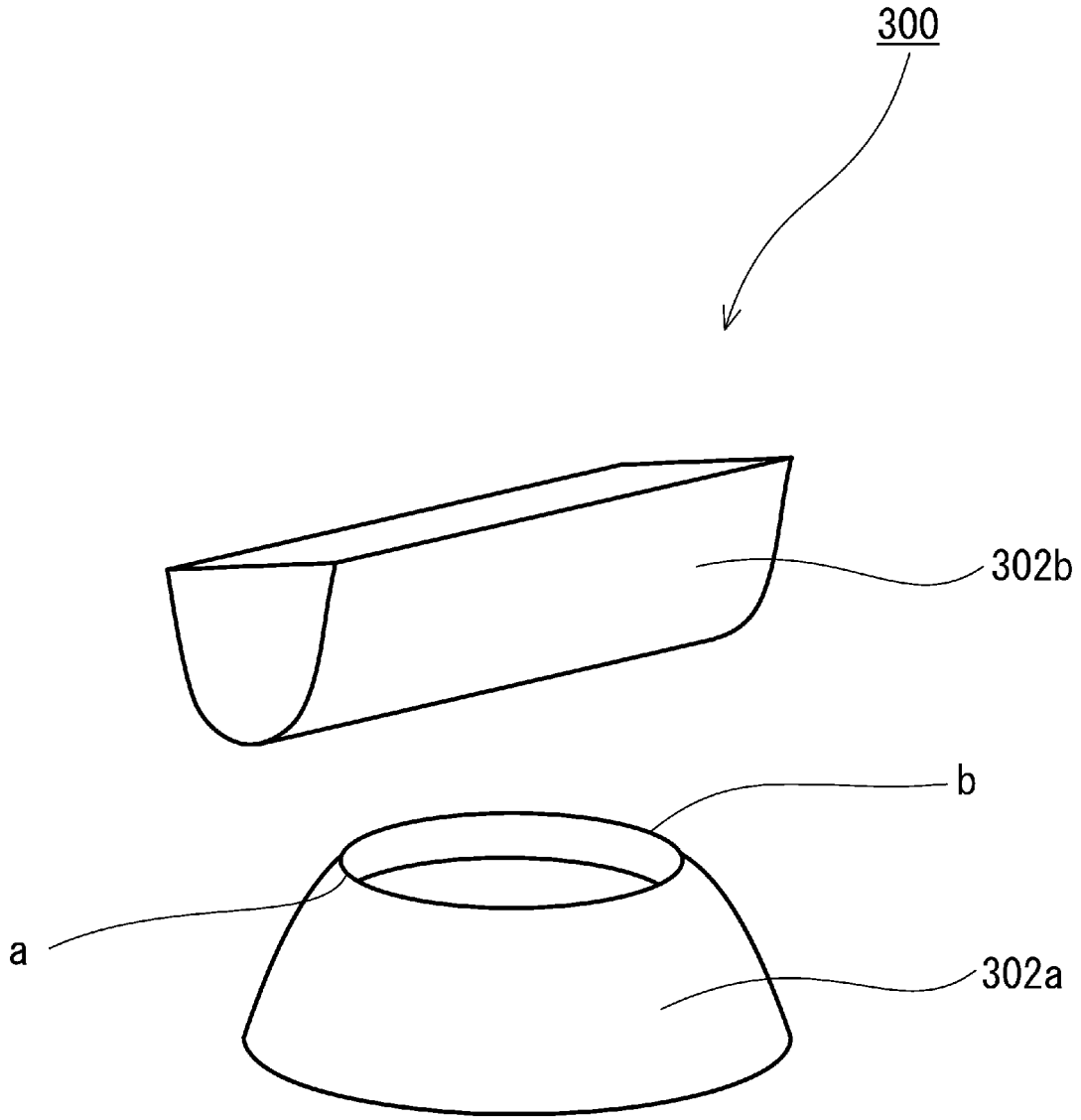

[Fig. 12]
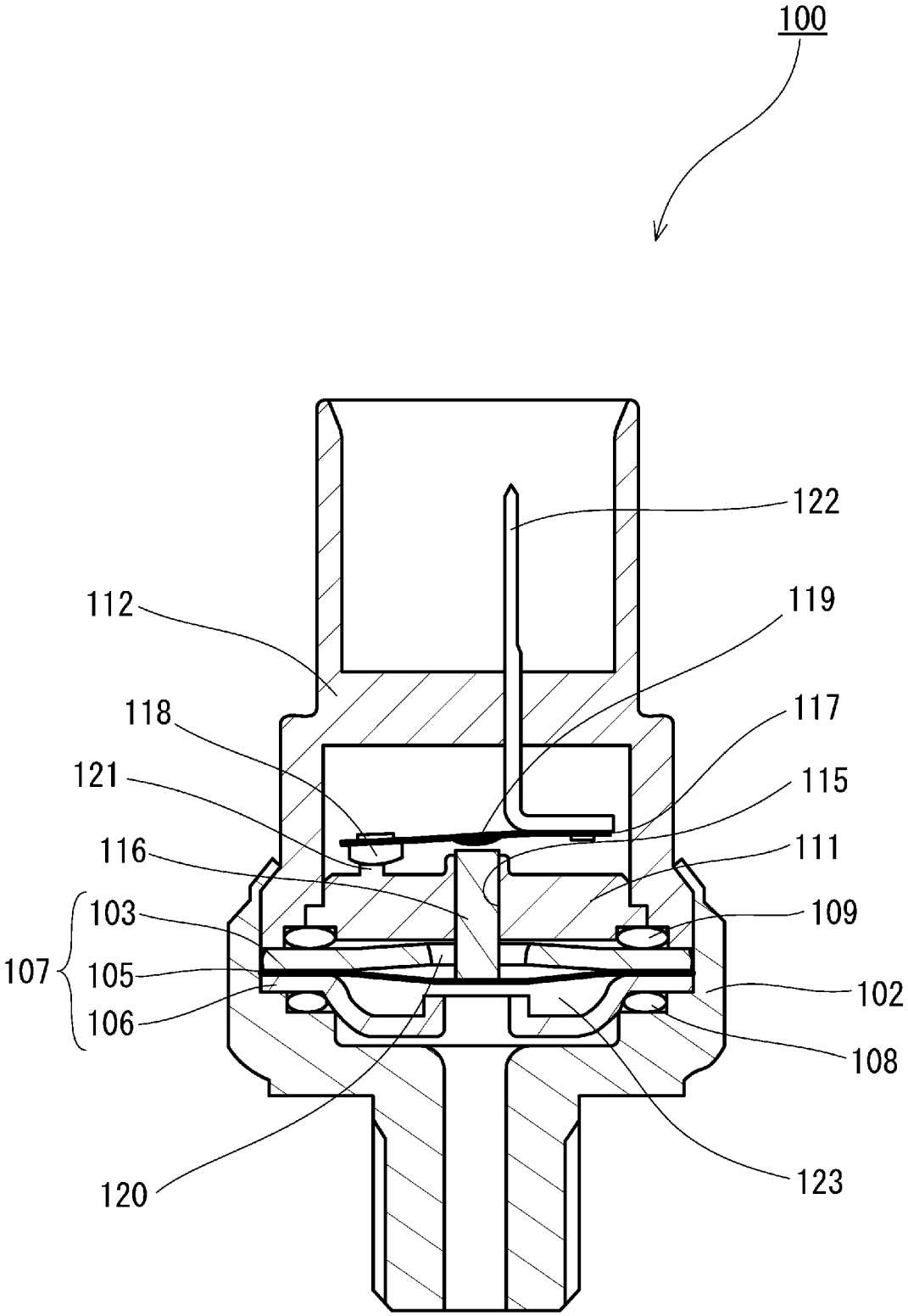

CONTACT STRUCTURE FOR SWITCH AND PRESSURE SWITCH USING THE SAME

CROSS-REFERENCE TO RELATED APPLICATIONS

This application is the United States national phase of International Application No. PCT/JP2013/078093 filed Oct. 16, 2013, and claims priority to Japanese Patent Application No. 2012-238068 filed Oct. 29, 2012, the disclosures of which are hereby incorporated in their entirety by reference.

TECHNICAL FIELD

The present invention relates to contact structures for switches and to pressure switches using the contact structures, and particularly relates to a contact structure for a mechanical-type switch opened or closed by allowing contacts to come into contact with or to separate from each other, and to a pressure switch using the contact structure.

BACKGROUND ART

Pressure switches have been conventionally used in order to detect the pressure of lubricating oil and to detect changes in the pressures of portions to be detected, such as the intake manifold pressures and exhaust pressures of engines, crank room pressures, and various controlling actuator working pressures, for example, in automobiles and the like.

FIG. 9 is a cross-sectional view for explaining the configuration of a conventional pressure switch.

In the pressure switch 100, a diaphragm configuration member 107 comprising an upper cover 103, a diaphragm 105, and a lower cover 106 is arranged via an O-ring 108 in the interior of a body portion 102.

An O-ring 109 is placed on the upper portion of the upper cover 103, a guide portion 111 is placed thereon, and a connector portion 112 is put so as to immobilize them. In addition, the outer circumferential stepped portion of the connector portion 112 is swaged with the open end of the body portion 102, whereby they are integrated to form a pressure switch.

An actuating shaft 116 that is slidably held in a through-hole 115 disposed in the center of the guide portion 111 is arranged on the upper part of the diaphragm 105, and its upper end is opposed to an actuation portion 119 of a movable contact plate 117.

The bottom end of the actuating shaft 116 comes into contact with the diaphragm 105 through an opening 120 in the upper cover 103. A first connecting terminal 122 and a second connecting terminal 124 that are bent in generally L-shapes are disposed in the connector portion 112, and one end of the movable contact plate 117 is fixed on an end of the first connecting terminal 122 by swaging.

A movable contact 118 is mounted on the other end of the movable contact plate 117, and a fixed contact 125 is fixed on an end of the second connecting terminal 124 so as to be opposed to the movable contact 118. A micro switch is formed by the fixed contact 125 and the movable contact 118.

The pressure switch 100 configured in such a manner is mounted so that the pressure of the interior of an actuation room 123 in a portion beneath the diaphragm 105 is equal to the pressure of the above-mentioned portion to be detected, and is used.

With increasing the pressure of the portion to be detected, the pressure of the interior of the actuation room 123 is also increased, and the center of the diaphragm 105 gradually rises with the increase. When the pressure becomes not less than predetermined pressure and the center of the diaphragm 105 rises over a neutral position and crosses an invertible region, the center of the diaphragm 105 is inverted and actuated upward, and the diaphragm 105 abuts on the lower end face of the upper cover 103 and stops.

As a result, the actuating shaft 116 moves up to a raised position to push up the movable contact plate 117, the movable contact 118 on its leading end is displaced upward, and the movable contact 118 and the fixed contact 125 become in a non-contact state.

The pressure switch 100, which is referred to as a normally closed type, becomes in a conduction state when the pressure of the portion to be detected is not more than the predetermined pressure (in a normal case) and becomes in a non-conduction state, only when the pressure of the portion to be detected is not less than the predetermined pressure, to thereby make it possible to detect a change in the pressure of the portion to be detected.

Pressure switches include a pressure switch, referred to as a normally open type, which becomes in a non-conduction state when the pressure of a portion to be detected is not more than predetermined pressure (in a normal case) and becomes in a conduction state, only when the pressure of the portion to be detected is not less than the predetermined pressure, to thereby make it possible to detect a change in the pressure of the portion to be detected.

In such a pressure switch, for example, a contact structure 200 in which rivet-type contacts 202*a* and 202*b* are places to be opposed to each other as illustrated in FIG. 10 has been conventionally used. However, there has been a problem that a conduction failure between the contacts occurs due to adhesion of a foreign substance to the contacts, or the like.

Therefore, JP-A-2000-322963 discloses a switch having a contact structure 300 in which a first contact is a doughnut-type contact 302*a*, and a second contact is a crossbar-type contact 302*b* that extends in a direction crossing the doughnut-type contact 302*a* as illustrated in FIG. 11.

A first contact is allowed to be the doughnut-type contact 302*a* in such a manner, whereby a conduction failure is precluded since the contact points between the contacts become many points and a foreign substance can be dissipated into the depression of the doughnut-type contact 302*a* even when entering between the contacts.

JP-A-2002-343207 discloses that a body-ground-type pressure switch configured so that one or a plurality of recesses are disposed in the upper portion of a protrusion 121 disposed on a guide portion 111, and electrical contact between a movable contact 118 and a protrusion 121 occurs on a plurality of contact points as illustrated in FIG. 12.

SUMMARY OF THE INVENTION

Problems to be Solved by the Invention

However, in the contact structure illustrated in FIG. 11 of JP '963, the doughnut-type contact 302*a* and the crossbar-type contact 302*b* come into point contact with each other at two points of an a-point and a b-point, a contact region is therefore small, and a conduction failure has been able to occur.

In addition, the contact structure of the pressure switch disclosed in JP '207 has been able to be utilized only as a normally closed type but has not been able to be used in a normally open type pressure switch.

In view of such a current situation, an objective of the present invention is to provide a contact structure for a switch, in which a contact region is increased, a conduction failure can be more precluded, and the operational reliability of the switch can be improved by allowing contact points between contacts to be line contacts, and to provide a pressure switch using the contact structure.

Furthermore, an objective of the present invention is to provide a contact structure for a switch, in which commonality of contact components in a normally closed type and a normally open type can be allowed to reduce the number of components by configuring movable contacts so as to be vertically symmetric with respect to a movable contact plate, and to provide a pressure switch using the contact structure.

SUMMARY OF THE INVENTION

The present invention is achieved in order to solve such problems as mentioned above in the conventional art. A contact structure for a switch of the present invention is a contact structure for a switch comprising a pair of contacts that are opposed to each other to open or close the switch by allowing the contacts to come into contact with or to separate from each other, wherein a contact surface of a first contact is formed into a concave shape provided with a projection and a recess;

a contact surface of a second contact is formed into a rounded surface; and planes of two projections in the first contact and the rounded surface of the second contact are configured to come into line contact with each other.

In the present invention, at least one surface of a surface of the first contact and a surface of the second contact may be subjected to plating working with a material with good conductivity.

At least one of the first contact and the second contact may also comprise a clad portion of a clad material.

At least one of the first contact and the second contact may also be disposed by rivet swaging.

The recess is preferably formed by crushing working by press forming.

The present invention comprises a movable terminal comprising:

a fixed portion formed of a conductive flat plate;

a movable contact plate that is formed of an elastic material and connected to a first end of the fixed portion; and the movable contact disposed on a second end, which is not connected to the fixed portion, of the movable contact plate, wherein the movable contact is preferably either the first contact or the second contact.

In this case, the movable contact plate can be configured so that a biasing force is exerted in a direction to permit the movable contact to abut on the fixed contact.

The movable contact plate may also be configured so that a biasing force is exerted in a direction of separating the movable contact from the fixed contact.

In the present invention, the movable contacts are preferably symmetrically disposed on both surfaces with respect to the movable contact plate.

A hole can also be disposed in the movable contact plate.

A pressure switch of the present invention comprises any one contact structure for a switch mentioned above.

In accordance with the present invention, a contact region is increased, a conduction failure can be more precluded, and the operational reliability of the switch can be improved by allowing contact points between contacts to be line contacts.

Furthermore, commonality of contact components in a normally closed type and a normally open type can be allowed to reduce the number of components by configuring movable contacts so as to be vertically symmetric with respect to a movable contact plate.

BRIEF DESCRIPTION OF DRAWINGS

FIG. 1 is a schematic view illustrating the configuration of a contact structure for a switch of the present example.

FIG. 2 is a cross-sectional view for explaining the configuration of a pressure switch having the contact structure of FIG. 1.

FIG. 3 is a schematic view illustrating the configuration of another example of a contact structure for a switch of the present invention.

FIG. 4 is a cross-sectional view for explaining the configuration of a pressure switch having the contact structure of FIG. 3.

FIG. 5 is a schematic view for explaining a step of symmetrically disposing movable contacts on both surfaces with respect to a movable contact plate by press working.

FIG. 6 is a schematic view for explaining the configuration of a movable contact plate in the contact structure of FIG. 3.

FIG. 7 is a schematic view illustrating the configuration of a still another example of a contact structure for a switch of the present invention.

FIG. 8 is a schematic view illustrating the configuration of a still another example of a contact structure for a switch of the present invention.

FIG. 9 is a cross-sectional view for explaining the configuration of a conventional pressure switch.

FIG. 10 is a schematic view for explaining the configuration of an example of a contact structure used in a conventional pressure switch.

FIG. 11 is a schematic view for explaining the configuration of another example of a contact structure used in a conventional pressure switch.

FIG. 12 is a cross-sectional view for explaining the configuration of a conventional body-ground-type pressure switch.

DESCRIPTION OF EMBODIMENTS

Embodiments (examples) of the present invention will now be described in more detail based on the drawings.

FIG. 1 is a schematic view illustrating the configuration of a contact structure for a switch of the present example, and FIG. 2 is a cross-sectional view for explaining the configuration of a pressure switch having the contact structure of FIG. 1.

In the present example, the same components as those in a conventional pressure switch 100 illustrated in FIG. 6 are denoted by the same reference characters, and the detailed description thereof is omitted.

As illustrated in FIGS. 1 and 2, the contact structure 10 of the present example comprises a fixed terminal 12 and a movable terminal 18.

The fixed terminal 12 is formed by working a conductive flat plate such as, for example, brass into a generally L-shape, and a recess 14 is disposed in one end 12*a* of the fixed terminal 12, for example, by crushing working by press forming.

In addition, the one end 12*a* of the fixed terminal 12, in which the recess 14 is disposed, is a fixed contact 16 to come into contact with a contact of the movable terminal 18. The fixed contact 16 is subjected to plating with, for example, a material having excellent conductivity (referred to herein as "material with good conductivity") such as a noble metal, such as gold or silver, or an alloy containing a noble metal, such as an alloy of silver and tin in order to improve conductivity with the movable terminal 18.

The recess 14 is disposed only on a surface coming into contact with a movable contact 24 of the movable terminal 18 mentioned later, and each of projections 17*a* and 17*b* of the fixed contact 16 comes into line contact with the movable contact 24.

The fixed contact 16 is formed into a concave shape in such a manner, whereby even when a foreign substance enters between the fixed contact 16 and the movable contact 24, the foreign substance can be dissipated into the recess 14, and a conduction failure is precluded.

Meanwhile, the movable terminal 18 comprises a fixed portion 20, a movable contact plate 22, and the movable contact 24.

The fixed portion 20 is formed of a conductive flat plate such as, for example, brass, and the movable contact plate 22 is connected to a first end of the fixed portion 20.

The movable contact plate 22 is formed of an elastic material such as, for example, a flat spring, and the movable contact 24 is disposed on a second end that is not connected to the fixed portion 20.

The movable contact plate 22 is configured so that a biasing force is exerted in the direction of allowing the movable contact 24 to abut on the fixed contact 16 of the fixed terminal 12.

As a result, in a normal case, the fixed contact 16 and the movable contact 24 are in the state of coming into contact with each other, and the fixed terminal 12 and the movable terminal 18 are in a conduction state (normally closed).

In addition, the movable contact 24 is disposed to protrude from the movable contact plate 22 in the direction of the fixed contact 16, and a contact surface (surface coming into contact with the fixed contact 16) of the movable contact 24 is a rounded surface. The movable contact 24 has a crossbar shape to be configured to come into contact with the projections 17*a* and 17*b*.

The movable contact 24 as described above may be formed by joining a material with good conductivity to the movable contact plate 22 by welding or the like or may be formed by plating with a material with good conductivity. In addition, the movable contact plate 22 and the movable contact 24 can also be formed integrally with each other using, for example, a clad material referred to as an edgelay clad.

The contact structure 10 for a switch of the present example, configured in such a manner, can be used as a component in a pressure switch 50 as illustrated in FIG. 2.

The pressure switch 50 can be used as a normally closed type pressure switch.

In the present example, the contact surface of the fixed contact 16 is formed into a concave shape, and the contact surface of the movable contact 24 is formed into a rounded surface. However, the contact surface of a first contact may have a concave shape, and the contact surface of a second contact maybe a rounded surface. The contact surface of the fixed contact 16 may also be formed into a rounded surface, and the contact surface of the movable contact 24 may also be formed into a concave shape.

FIG. 3 is a schematic view illustrating the configuration of another example of a contact structure for a switch of the present invention, and FIG. 4 is a cross-sectional view for explaining the configuration of a pressure switch having the contact structure of FIG. 3.

Since a contact structure 10 and a pressure switch 50 of the present example basically have configurations similar to those of the contact structure 10 and the pressure switch 50 illustrated in FIGS. 1 and 2, the same components are denoted by the same reference characters, and the detailed description thereof is omitted.

In the contact structure 10 illustrated in FIG. 1, the movable contact plate 22 is configured so that a biasing force is exerted in the direction of allowing the movable contact 24 to abut on the fixed contact 16 of the fixed terminal 12. However, in the contact structure 10 of the present example, a movable contact plate 22 is configured so that a biasing force is exerted in the direction of separating movable contacts 24 from a fixed contact 16 of a fixed terminal 12.

By such a configuration as described above, the fixed contact 16 and the movable contact 24 become in a non-contact state in a normal case, and the fixed terminal 12 and a movable terminal 18 become in a non-conduction state (normally open).

In addition, the movable contacts 24 of this example are symmetrically disposed on both surfaces with respect to the movable contact plate 22.

The movable terminal 18 is configured in which the movable contacts 24 are symmetrically disposed on both surfaces with respect to the movable contact plate 22 in such a manner, whereby the same movable terminal 18 can be used even in the contact structure 10 used in the normally closed type pressure switch illustrated in FIG. 1. Therefore, commonality of the movable terminals 18 in a normally closed type and a normally open type can be allowed to reduce the number of components.

The movable contacts 24 can also be easily symmetrically disposed on both surfaces with respect to the movable contact plate 22 in such a manner, for example, by forming a tri-metal wire rod 30 into a predetermined shape by press working as illustrated in FIG. 5.

In FIG. 5, reference numeral 32 denotes a press upper die while reference numeral 34 denotes a press lower die.

In the contact structure 10 illustrated in FIG. 1, the fixed contact 16 of the fixed terminal 12 is configured by subjecting the surface of the fixed terminal 12 to plating working. However, in the present example, a clad material referred to as an edgelay clad is worked in a generally L-shape to form the fixed terminal 12, and a clad portion of the clad material is used as the fixed contact 16.

The fixed terminal 12 is formed of the clad material in such a manner, whereby time of plating working can be saved, and furthermore, the operational reliability of the switch can be further improved since peeling as in the case of plating is prevented.

In addition, the movable contact plate 22 of the present example is provided with a hole 23 as illustrated in FIG. 6. The movable contact plate 22 is provided with the hole 23 in such a manner, whereby, for example, even when a foreign substance enters between a projection 17*a* of the fixed contact 16 and the movable contact 24, the movable contact plate 22 inclines, a projection 17*b* of the fixed contact 16 and the movable contact 24 reliably come into contact with each other, and the malfunction of the switch is precluded.

FIG. 7 is a schematic view illustrating the configuration of a still another example of a contact structure for a switch of the present invention.

Since a contact structure 10 of the present example basically has a configuration similar to that of the contact structure 10 illustrated in FIG. 1, the same components are denoted by the same reference characters, and the detailed description thereof is omitted.

In addition, the contact structure 10 of the present example is used as in the case of the contact structure 10 in the pressure switch 50 illustrated in FIGS. 2 and 4.

In the contact structure 10 illustrated in FIG. 7, a contact surface (surface coming into contact with a movable contact 24) of a fixed contact 16 is a rounded surface, and the movable contact 24 is provided with a recess 14 and projections 17*a* and 17*b*.

As a method for manufacturing such a fixed contact 16, the fixed contact 16 can be formed, for example, using means referred to as a toplay clad.

As a method for forming the contact surface of the fixed contact 16 into a rounded surface, the surface may be rounded when the toplay clad is formed, or the surface may be rounded by post-working, for example, when the fixed terminal 12 is molded.

By using a clad material in the fixed terminal 12, the fixed terminal 12 can be shortened, the need for disposing the fixed contact 16 by post-working is eliminated, and the need of space for working is eliminated.

Therefore, adoption of the contact structure of the present invention in a microswitch or the like can result in downsizing of the switch and in reduction in the constraints of designing other components used in the switch.

Furthermore, since a step of joining a contact, such as, for example, swaging or welding, for disposing the fixed contact 16 on the fixed terminal 12 can be omitted, a manufacturing step can be simplified, mistakes and work time can be reduced, and a manufacture cost can be reduced.

FIG. 8 is a schematic view illustrating the configuration of a still another example of a contact structure for a switch of the present invention.

Since a contact structure 10 of the present example basically has a configuration similar to that of the contact structure 10 illustrated in FIG. 1, the same components are denoted by the same reference characters, and the detailed description thereof is omitted.

In addition, the contact structure 10 of the present example is used as in the case of the contact structure 10 in the pressure switch 50 illustrated in FIGS. 2 and 4.

In the contact structure 10 illustrated in FIG. 8, a fixed contact 16 of a fixed terminal 12 is disposed by rivet swaging.

When the fixed contact 16 is disposed by rivet swaging in such a manner, a recess 14 and projections 17*a* and 17*b* may be pre-molded on a rivet 40, or the recess 14 and the projections 17*a* and 17*b* may be molded by press working simultaneously with the rivet swaging.

Although the movable contact 24 illustrated in FIG. 8 has a structure in which part of a surface coming into contact with the fixed contact 16 is provided with a rounded surface, the whole surface coming into contact with the fixed contact 16 can also be formed into a rounded surface. Such a configuration can result in reduction in the loss of a noble metal used in the contact and can result in inexpensive manufacture compared to the case of formation using a clad material.

In the present example, only the fixed contact 16 is disposed by rivet swaging. However, movable contacts 24 of a movable terminal 18 can also be disposed by rivet swaging. In this case, the movable contacts 24 having symmetrical shapes can be disposed on both surfaces with respect to a movable contact plate 22 by molding the movable contacts 24 by press working simultaneously with the rivet swaging.

The preferred embodiments of the present invention are explained above, but the present invention is not limited thereto. Various modifications, in which, for example, a material for the movable terminal, the fixed terminal, and the like can be appropriately selected from known materials, can be made without departing from the objectives of the present invention.

The invention claimed is:

1. A contact structure for a switch comprising:

a pair of contacts that are opposed to each other to open or close the switch by allowing the contacts to come into contact with or to separate from each other, wherein a contact surface of a first contact is formed into a concave shape provided with at least two projections and a recess, a contact surface of a second contact is formed into a convex-curved surface, and planes of two projections in the first contact and the convex-curved surface of the second contact are configured to come into line contact with each other while the first contact is configured to not contact the convex-curved surface of the second contact in an area of the recess; and a movable terminal comprising:

a fixed portion formed of a conductive flat plate;

a movable contact plate that is formed of an elastic material and has a first end and a second end, wherein the first end of the movable contact plate is connected to the fixed portion; and a movable contact disposed on a first portion of the movable contact plate at the second end of the movable contact plate, wherein the movable contact is rigidly fixed to the moveable contact plate, wherein the movable contact plate is configured to be inclinable to thereby allow the convex-curved surface to be in contact with at least one of the two projections, and wherein the movable contact is either the first contact or the second contact and a hole is disposed in a second portion of the movable contact plate located adjacent to the first portion of the movable contact plate and spaced apart from the first end of the movable contact plate.

2. The contact structure for a switch according to claim 1, wherein at least one surface of the contact surface of the first contact and the contact surface of the second contact is subjected to plating working with a material with good conductivity.

3. The contact structure for a switch according to claim 1, wherein at least one of the first contact and the second contact comprises a clad portion of a clad material.

4. The contact structure for a switch according to claim 1, wherein at least one of the first contact and the second contact is disposed by rivet swaging.

5. The contact structure for a switch according to claim 1, wherein the recess is formed by crushing working by press molding.

6. The contact structure for a switch according to claim 1, wherein the movable contact plate is configured so that a biasing force is exerted in a direction to permit the movable contact to abut on the fixed contact.

7. The contact structure for a switch according to claim 1, wherein the movable contact plate is configured so that a biasing force is exerted in a direction of separating the movable contact from the fixed contact.

8. The contact structure for a switch according to claim 1, further comprising a second movable contact disposed on the second end, wherein the movable contacts are symmetrically disposed on both surfaces with respect to the movable contact plate.

9. A pressure switch comprising the contact structure for a switch according to claim 1.

10. The contact structure for a switch according to claim 1, wherein the second contact is the movable contact.

11. The contact structure for a switch according to claim 1, wherein the first contact is the movable contact.

12. The contact structure for a switch according to claim 1, wherein the at least two projections each form a horizontal plane.

13. The contact structure for a switch according to claim 12, wherein the second contact is formed into a crossbar shape.

14. The contact structure for a switch according to claim 13, wherein the crossbar shape is elongated, such that the crossbar shape forms a line contact with each of the horizontal planes.

* * * * *